US009024163B2

(12) United States Patent
Sato et al.

(10) Patent No.: US 9,024,163 B2
(45) Date of Patent: May 5, 2015

(54) DRUM SUPPORTING DEVICE AND DRUM

(71) Applicant: Hoshino Gakki Co., Ltd., Nagoya, Aichi (JP)

(72) Inventors: Naoki Sato, Nagoya (JP); Hideyuki Miyajima, Nagoya (JP)

(73) Assignee: Hoshino Gakki Co., Ltd., Nagoya (JP)

( * ) Notice: Subject to any disclaimer, the term of this patent is extended or adjusted under 35 U.S.C. 154(b) by 250 days.

(21) Appl. No.: 13/689,591

(22) Filed: Nov. 29, 2012

(65) Prior Publication Data

US 2014/0026735 A1 Jan. 30, 2014

(30) Foreign Application Priority Data

Jul. 24, 2012 (JP) ..... 2012-163776

(51) Int. Cl.
*G10D 13/02* (2006.01)

(52) U.S. Cl.
CPC ..... *G10D 13/026* (2013.01); *G10D 13/02* (2013.01)

(58) Field of Classification Search
CPC ..... G10D 13/026; G10D 13/02
USPC ..... 84/421
See application file for complete search history.

(56) References Cited

U.S. PATENT DOCUMENTS

| | | | | |
|---|---|---|---|---|
| 4,158,980 | A * | 6/1979 | Gauger | 84/421 |
| 5,454,288 | A | 10/1995 | Hoshino | |
| 5,544,561 | A | 8/1996 | Isomi | |
| 5,645,253 | A * | 7/1997 | Hoshino | 248/181.1 |
| 6,107,555 | A | 8/2000 | Hoshino | |
| 6,552,253 | B1 | 4/2003 | Chen | |
| 7,906,718 | B1 * | 3/2011 | Liao | 84/411 R |

FOREIGN PATENT DOCUMENTS

| | | | |
|---|---|---|---|
| JP | 03-111895 | A | 5/1991 |
| JP | P05-127669 | A | 5/1993 |
| JP | 3014483 | U | 5/1995 |
| JP | 11-161265 | A | 6/1999 |

OTHER PUBLICATIONS

Japanese Office Action dated Jun. 10, 2014 issued in the application No. 2012-163776.

* cited by examiner

*Primary Examiner* — Jianchun Qin

(57) ABSTRACT

A tom-tom supporting device includes a bracket, a first arm having a plurality of first supporting portions for supporting an upper hoop, and a second arm having a second supporting portion for supporting a lower hoop. Two of the first supporting portions provided at ends of the first arm are each located near one of two intersection points at which a diameter of a batter head, which is perpendicular to a vertical plane containing an axis of a shell and an axis of the second arm, intersects the upper hoop.

13 Claims, 7 Drawing Sheets

DRUM SUPPORTING DEVICE AND DRUM

BACKGROUND OF THE INVENTION

The present invention relates to a drum supporting device for supporting a drum, such as a tom-tom, on a bass drum or a stand, for instance. The present invention also pertains to a drum.

A drum set includes one or more of tom-toms mounted above a bass drum. A tom-tom is mounted by use of a holder attached to a bass drum or a cymbal stand, or a dedicated tom-tom stand, or the like. For example, Patent Documents cited below disclose a drum support systems applied to a holder or a tom-tom stand for mounting a tom-tom.

In the drum support system disclosed in the specification of U.S. Pat. No. 5,544,561, a plurality of clamping members is attached to an upper end of a bracket. Also, at a lower end of the bracket, one supporting projection is attached. According to this structure, bolts of the clamping members are tightened with an upper hoop of the drum grasped between the clamping members and the bracket. In this structure, the clamping members support the upper hoop and the supporting projection abuts against a surface of a shell. The drum is attached to the bracket in this state and attached to a holder or a tom-tom stand, for example.

In the drum support system disclosed in the specification of U.S. Pat. No. 5,454,288, a semi-circular arm extending along an upper hoop is fixed to an upper end of a bracket. There is also provided one each arm-side attaching portion at a middle portion and both ends of the arm. On the other hand, a hoop-side attaching portion is provided at a location of the upper hoop of the drum corresponding to each arm-side attaching portion. According to this structure, the arm is placed along a lower edge of the upper hoop and the three arm-side attaching portions are fixed to the corresponding hoop-side attaching portions by screws, respectively. In this structure, the middle portion and both ends of the arm are fixed to the upper hoop to mount the drum on the bracket.

Also, in the drum support system disclosed in Japanese Laid-Open Patent Publication No. 5-127669, a pair of hoop-side attaching portions is attached to an upper hoop and a single hoop-side attaching portion is attached to a lower hoop. According to this structure, two locations of an upper end of a bracket are fixed to the pair of hoop-side attaching portions while one location of a lower end of the bracket is fixed to the hoop-side attaching portion by use of screws. In this structure, the upper and lower ends of the bracket are fixed to the upper and lower hoops, respectively, to mount the drum on the bracket.

According to the drum support system disclosed in the specification of U.S. Pat. No. 5,544,561, however, vibration of the shell is impeded by the supporting projection when the drum is struck since the drum is supported with the supporting projection abutted against the surface of the shell. For this reason, it is impossible to draw out the maximum potential of the vibration of the shell or to sufficiently obtain true sustain and sound volume of the drum.

According to the drum support system disclosed in the specification of U.S. Pat. No. 5,454,288, vibration of the shell is not impeded by the arm because the arm is fixed to the upper hoop. However, since the arm is fixed only to the upper hoop, the drum's own weight is likely to concentrate upon the upper hoop. Accordingly, there is a risk that an impact produced when the drum is struck may cause the upper hoop to deform and the deformation of the hoop may affect the sound volume or sound quality of the drum.

According to the drum support system disclosed in Japanese Laid-Open Patent Publication No. 5-127669, on the other hand, it is possible to distribute the weight of the drum to the upper hoop and the lower hoop because the bracket is fixed to both the upper and lower hoops. However, since the hoop-side attaching portions attached to the upper hoop are positioned close to each other, the weight of the drum is still likely to concentrate on a portion of the upper hoop near the hoop-side attaching portions. Therefore, it is impossible to completely eliminate the potential deformation of the upper hoop caused by an impact produced when the drum is struck, and deformation of the hoop may affect the sound volume or sound quality of the drum.

SUMMARY OF THE INVENTION

It is an objective of the present invention to provide a drum supporting device and a drum that improve sound volume and sound quality of a drum.

To achieve the foregoing objective and in accordance with one aspect of the present invention, a drum supporting device for supporting a drum on a mount object on which the drum is mounted is provided. The drum includes a shell, first and second drum heads covering first and second open ends of the shell, respectively, a first hoop attached to the first open end of the shell together with the first drum head, and a second hoop attached to the second open end of the shell together with the second drum head. The drum supporting device includes a bracket joined to the mount object, a first arm, and a second arm. The first arm has at least two first supporting portions for supporting the first hoop. The first arm is provided at a first end of the bracket and extending in a circumferential direction of the shell. The second arm has a second supporting portion, and is provided at a second end of the bracket and extending in the direction of an axis of the shell. The two first supporting portions are respectively provided at opposite ends of the first arm and are each located near one of two locations at which a diameter of the first drum head intersects the first hoop. The diameter is perpendicular to a plane that contains the axis of the shell and a midpoint of the first arm in a longitudinal direction of the first arm.

In accordance with another aspect of the present invention, a drum is provided that includes a shell, first and second drum heads covering first and second open ends of the shell, respectively, a first hoop attached to the first open end of the shell together with the first drum head, a second hoop attached to the second open end of the shell together with the second drum head, a bracket joined to a mount object on which the drum is mounted, a first arm, and a second arm. The first arm has at least two first supporting portions for supporting the first hoop. The first arm is provided at a first end of the bracket and extending in a circumferential direction of the shell. The second arm has a second supporting portion, and is provided at a second end of the bracket and extending in the direction of an axis of the shell. The two first supporting portions are respectively provided at opposite ends of the first arm and are each located near one of two locations at which a diameter of the first drum head intersects the first hoop. The diameter is perpendicular to a plane that contains the axis of the shell and a midpoint of the first arm in a longitudinal direction of the first arm.

DETAILED DESCRIPTION OF THE PREFERRED EMBODIMENTS

A drum supporting device according to one embodiment of the present invention realized as a tom-tom supporting device will be described with reference to FIGS. 1 to 6B.

Figure 1:
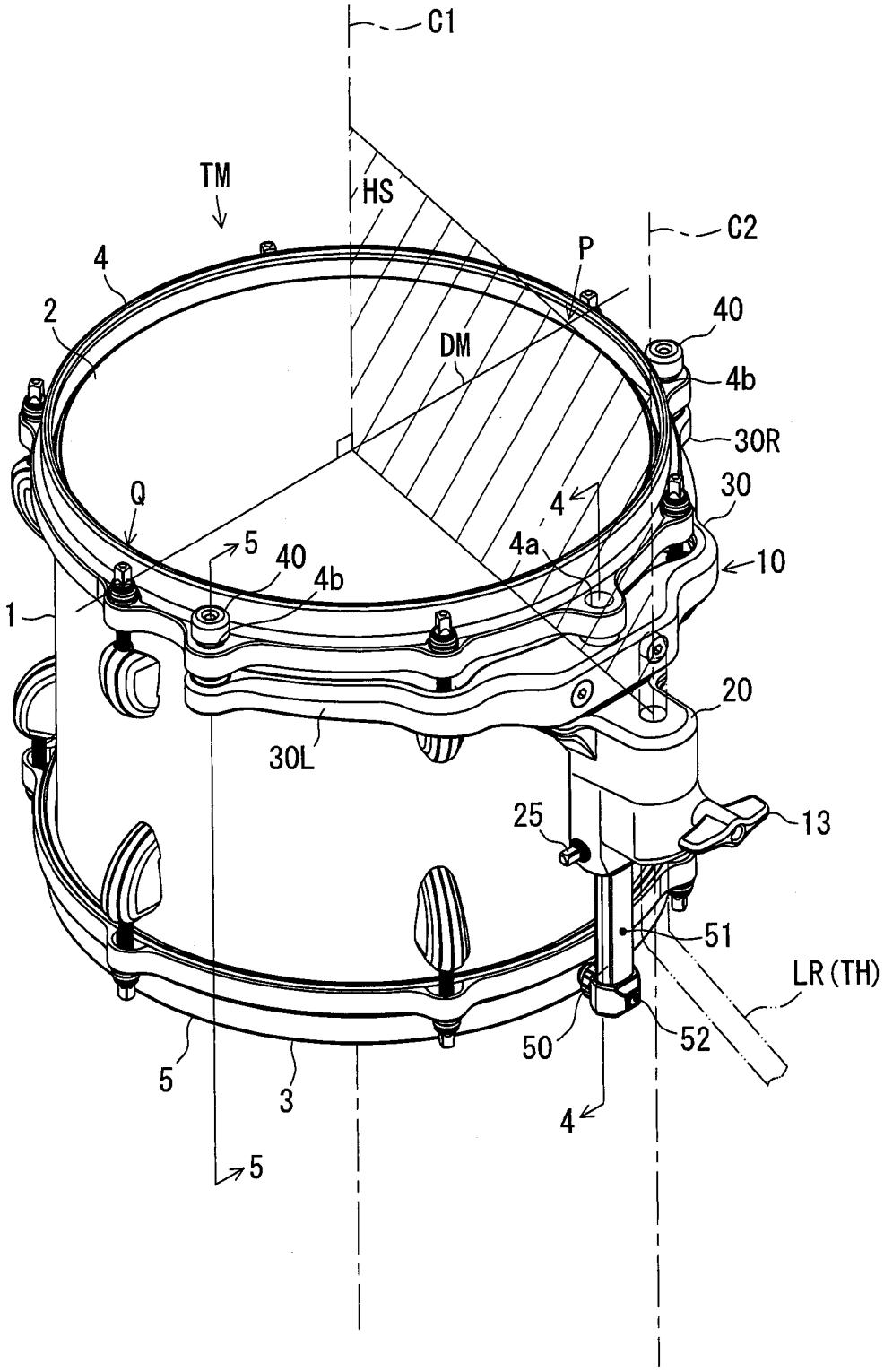
FIG. 1 is a perspective view of a tom-tom equipped with a tom-tom supporting device of the present invention.

As illustrated in FIG. 1, a tom-tom TM includes a cylindrical shell 1, a batter head 2, which serves as a first drum head covering an upper open end of the shell 1, a bottom head 3, which serves as a second drum head covering a lower open end of the shell 1, an upper hoop 4, which serves as a first hoop, and a lower hoop 5, which serves as a second hoop. The upper hoop 4 is attached to the upper open end of the shell 1 together with the batter head 2. The lower hoop 5 is attached to the lower open end of the shell 1 together with the bottom head 3. In this embodiment, the upper open end of the shell 1 constitutes a first open end and the lower open end of the shell 1 constitutes a second open end.

The tom-tom TM is equipped with a tom-tom supporting device 10. The tom-tom supporting device 10 is configured in a generally T-shape to support two locations of the upper hoop 4 and one location of the lower hoop 5. A tom-tom holder TH is fixed to a bass drum (not shown), which is a mount object on which the tom-tom TM is mounted. The tom-tom holder TH has an L-shaped rod LR. The tom-tom TM is mounted above the bass drum by fixing the tom-tom supporting device 10 onto the L-shaped rod LR.

Figure 2:
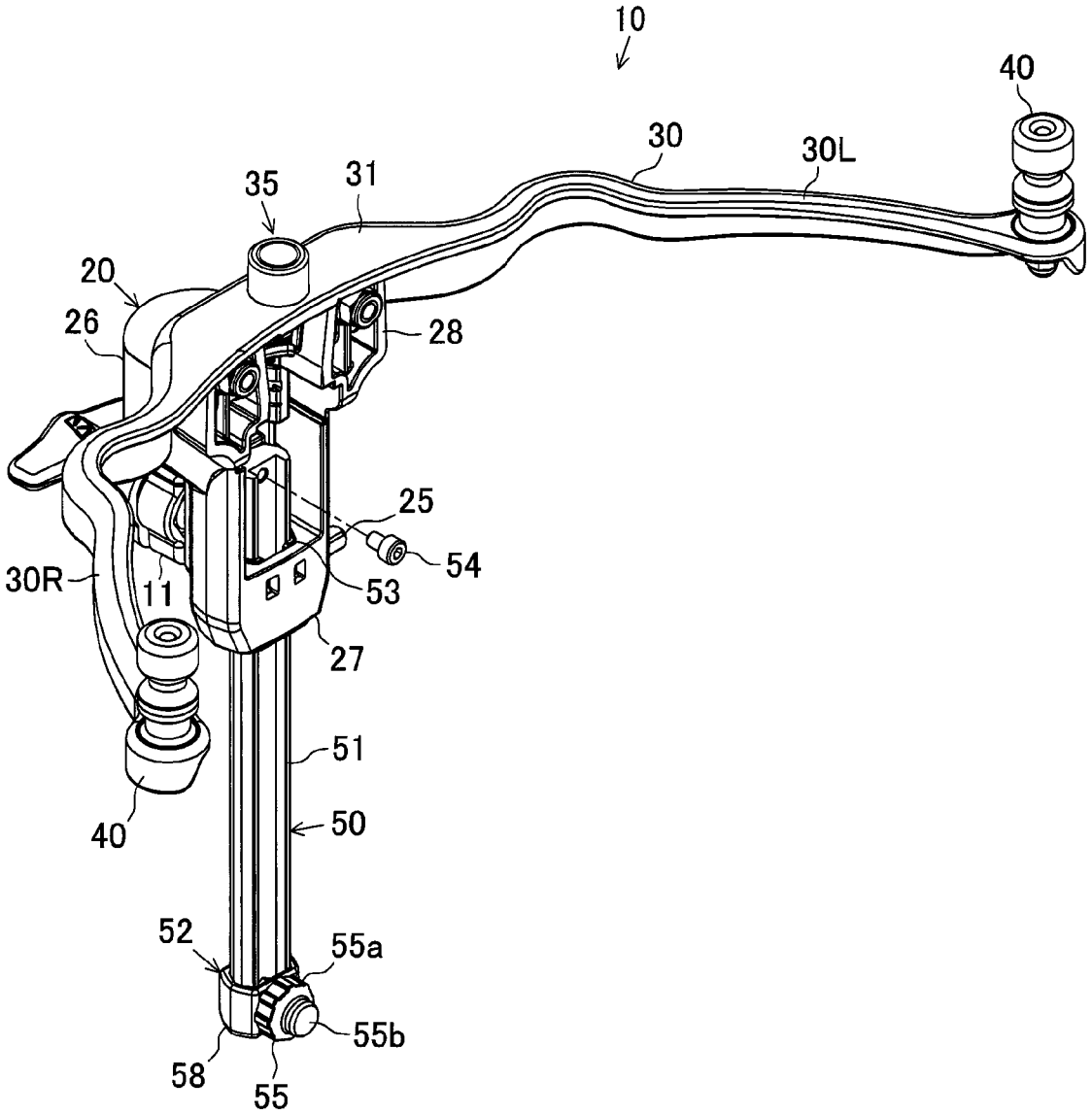
FIG. 2 is a perspective view of the tom-tom supporting device.

As depicted in FIGS. 1 and 2, the tom-tom supporting device 10 includes a bracket 20, a first arm 30, which extends in a circumferential direction of the shell 1, and a second arm 50, which extends along an axis C1 of the shell 1. The first arm 30 is provided at an upper end, or a first end, of the bracket 20. The second arm 50 is provided at a lower end, or a second end, of the bracket 20. The bracket 20 is joined to a distal end of the L-shaped rod LR.

Figure 3:
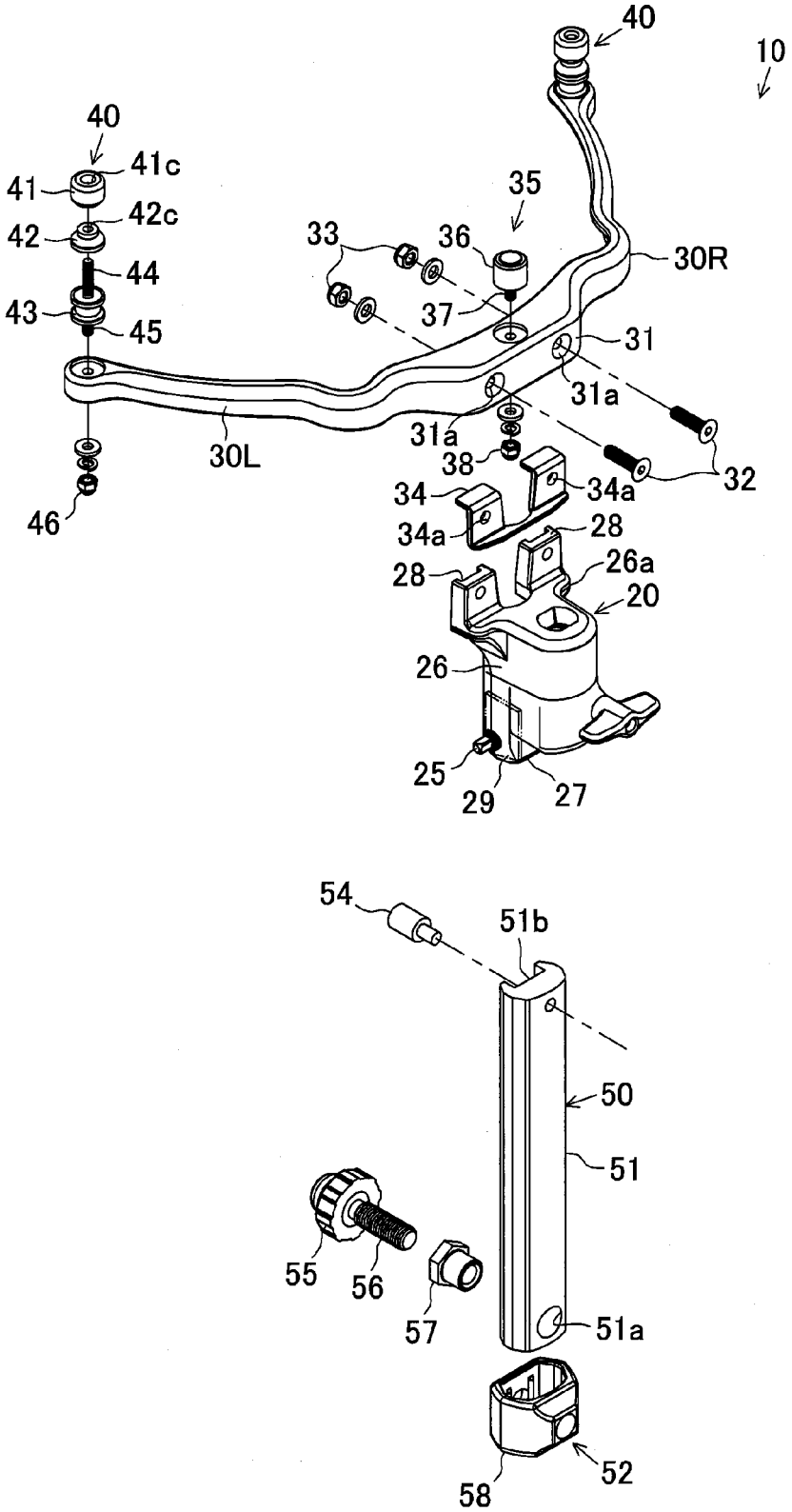
FIG. 3 is an exploded perspective view of the tom-tom supporting device.
Figure 4:
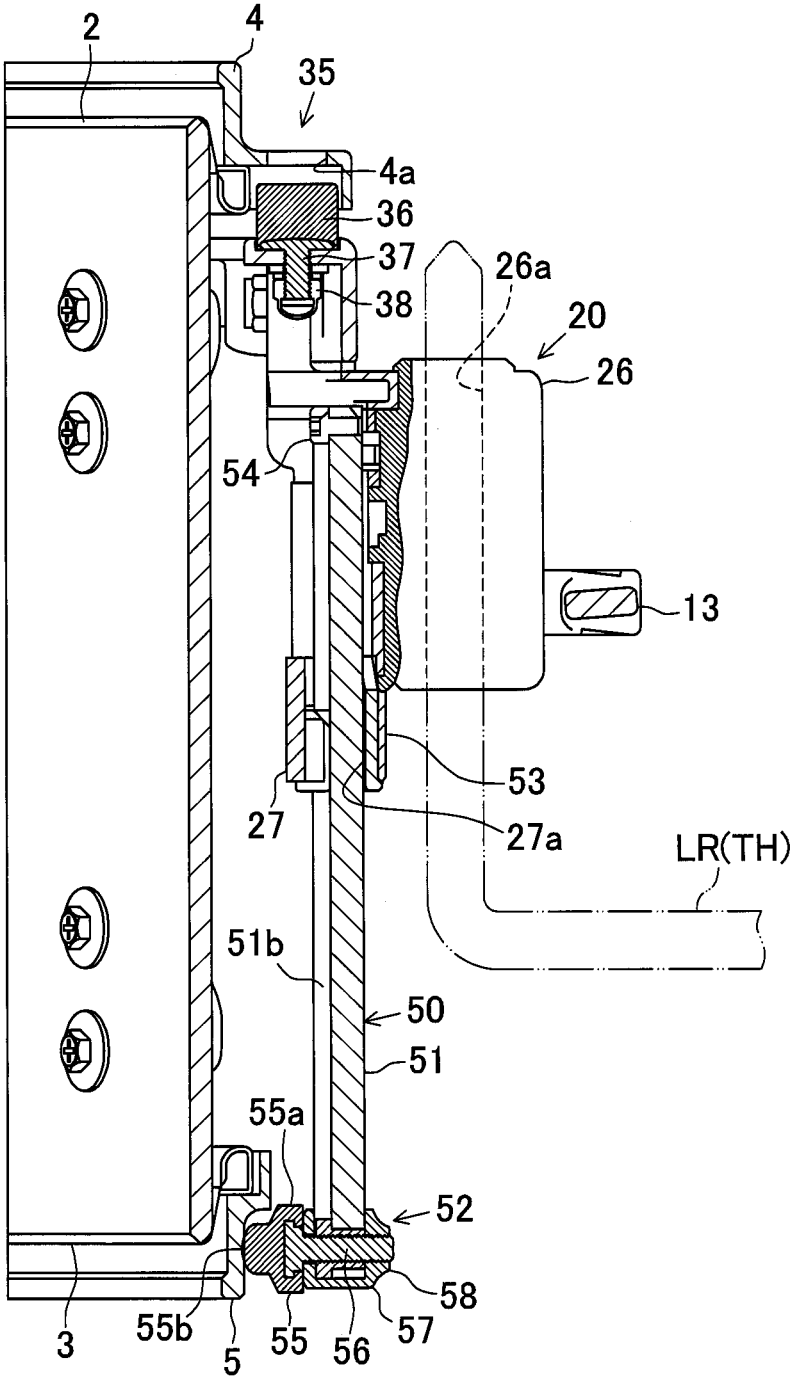
FIG. 4 is a partially cross-sectional view taken along line 4-4 of FIG. 1.

As depicted in FIGS. 3 and 4, the bracket 20 includes a generally boxlike upper section 26 and a lower section 27, which extends downward from the upper section 26. The upper section 26 has a through hole 26*a* formed therein, into which the L-shaped rod LR is inserted. At an upper end of the upper section 26, is formed a pair of attaching parts 28, which are attached to the first arm 30.

A horizontal hole is formed in a lower end portion of the lower section 27 for receiving a bolt 25 from one side. The lower section 27 has a supporting hole 27*a* formed therein for slidably supporting the second arm 50. Also, the lower section 27 incorporates an unillustrated nut bushing, which is fitted and secured on the bolt 25 as well as a retainer plate 29.

The structure of the first arm 30 will now be described with reference to FIGS. 3 to 5.

Referring to FIGS. 3 and 4, the first arm 30 is structured in an arcuate form having the same radius of curvature as the shell 1. The first arm 30 includes a middle portion 31, to which the bracket 20 is fixed, a right arm portion 30R, which extends rightward from the middle portion 31 as depicted in FIG. 3, and a left arm portion 30L, which extends leftward from the middle portion 31 as depicted in FIG. 3. The middle portion 31 has a pair of mounting holes 31*a* formed therein at locations corresponding to the attaching parts 28 of the bracket 20. The first arm 30 is attached to the attaching parts 28 of the bracket 20 by means of a pair of bolts 32 and a pair of nuts 33. A plate-like rubber vibration insulator 34 is placed between the middle portion 31 of the first arm 30 and the bracket 20. The rubber vibration insulator 34 has a pair of through holes 34*a* formed therein, through which the bolts 32 are passed.

The middle portion 31 is provided with a restrictive mechanism 35, which restricts contact between the upper hoop 4 and the first arm 30. The restrictive mechanism 35 includes a cylindrical rubber guide 36 and an attaching screw 37, which is fitted in the rubber guide 36 by insert molding. The restrictive mechanism 35 is fixed to the middle portion 31 by tightening a nut 38 on the attaching screw 37. The restrictive mechanism 35 is placed in position in this fashion, creating a gap between the rubber guide 36 and the upper hoop 4.

Referring to FIGS. 1 and 3, the right arm portion 30R and the left arm portion 30L are shaped to form a left-right symmetric structure extending on both sides of the middle portion 31, the two arm portions 30R, 30L having the same length. The right arm portion 30R and the left arm portion 30L extend up to points close to intersections P and Q, where a diameter DM of the batter head 2, which is perpendicular to a vertical plane HS, intersects the upper hoop 4. The vertical plane HS contains the axis C1 of the shell 1 and an axis C2 of the second arm 50, as shown in FIG. 1. First supporting portions 40 for supporting the upper hoop 4 are fixed to ends of the right arm portion 30R and the left arm portion 30L. Thus, the first supporting portions 40 are each located near one of the two intersections P, Q, where the diameter DM of the batter head 2 intersects the upper hoop 4. This pair of first supporting portions 40 is located at generally symmetrical positions with respect to the axis C1 of the shell 1. The positions where the first supporting portions 40 are located are closer to the intersections P, Q between the middle portion 31 and the intersections P, Q.

Figure 5:
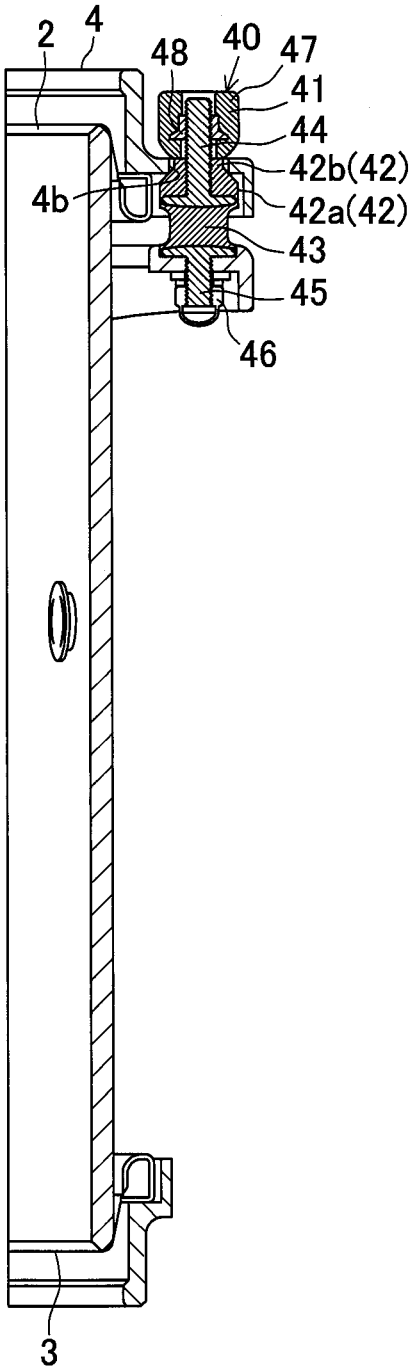
FIG. 5 is a partially cross-sectional view taken along line 5-5 of FIG. 1.

Referring to FIGS. 3 and 5, each of the first supporting portions 40 includes a nut 41, a seat 42 made of rubber, a rubber vibration insulator 43 made of a first vibration insulator material, and a pair of upper and lower attaching screws 44, 45. The attaching screws 44, 45 are securely attached to upper and lower end surfaces of the rubber vibration insulator 43 by insert molding, respectively. The first supporting portions 40 are fixed to the ends of the right arm portion 30R and the left arm portion 30L by tightening nuts 46 on the lower attaching screws 45.

The nut 41 and the seat 42 have through holes 41*c* and 42*c* formed therein, respectively, into which the upper attaching screw 44 is inserted. The nut 41 includes a first nut element 47 made of rubber and a second nut element 48 made of metal. The second nut element 48 is insert-molded in the first nut element 47. The nut 41 is fixed to an upper surface of the seat 42 by tightening the second nut element 48 on the attaching screw 44.

The seat 42 is made of a basal portion 42*a* and an end portion 42*b*, which has a smaller outside diameter than the basal portion 42*a*. The outside diameter of the end portion 42*b* is set smaller than an inside diameter of each of hoop attaching holes 4*b* formed in the upper hoop 4. An outer peripheral surface of the basal portion 42*a*, which contacts the upper hoop 4, is formed in a generally hemispherical shape. The seat 42 is attached onto the rubber vibration insulator 43 with the attaching screw 44 inserted in the through hole 42*c*. The seat 42 thus arranged is held in line contact along an edge of an opening of the relevant hoop attaching hole 4*b*.

Each of the first supporting portions 40 is engaged with the upper hoop 4 with the end portion 42*b* of the seat 42 fitted in one of the hoop attaching holes 4*b* and the nut 41 attached to the attaching screw 44 as depicted in FIG. 5. The tom-tom supporting device 10 supports the upper hoop 4 with distal ends of the pair of first supporting portions 40 engaged with the upper hoop 4 in the above-described manner. In this state, the rubber vibration insulator 43 exists between each of the first supporting portions 40 and the upper hoop 4. Thus, the first supporting portions 40 elastically support the upper hoop 4 and absorb vibration transmitted from the batter head 2 to the upper hoop 4 with the aid of the rubber vibration insulators 43.

Next, the structure of the second arm 50 will be described with reference to FIGS. 1 to 4, 6A and 6B.

Referring to FIGS. 1 and 2, the second arm 50 includes a support arm 51, which extends along the axis C1 of the shell 1, and a second supporting portion 52, which supports the lower hoop 5. The support arm 51 has a generally C-shaped cross section and extends straight in a direction perpendicular to the first arm 30.

The support arm 51 is supported at an upper part thereof, which is fitted in the supporting hole 27*a* formed in the lower section 27, with a guide bushing 53 placed in between. The support arm 51 is slidable along the axis C1 of the shell 1. The support arm 51 is made movable up and down relative to the bracket 20 when the bolt 25 is loosened. When the bolt 25 is tightened, in contrast, the support arm 51 is fixed to the bracket 20 via the retainer plate 29 illustrated in FIG. 3. This means that the second arm 50 is structured such that the height of the second supporting portion 52 can be adjusted by turning the bolt 25 and vertically moving the support arm 51.

Also, a screw 54 is securely fitted in the middle of an upper end of the support arm 51 from the side of the tom-tom TM. The screw 54 restricts a downward movement of the support arm 51 as the screw 54 contacts an end surface of the guide bushing 53 inside the supporting hole 27*a*. This means that the screw 54 holds the support arm 51 in position so that the support arm 51 will not fall from the bracket 20 when the bolt 25 is loosened.

As depicted in FIGS. 3 and 4, the second supporting portion 52 is provided at a lower end of the support arm 51. The second supporting portion 52 includes an adjuster knob 55 made of rubber used as a second vibration insulator material, a bolt 56 insert-molded in the adjuster knob 55, a nut bushing 57 and a cap 58.

A cylindrical part of the nut bushing 57 is inserted in a fixing hole 51*a* formed in the lower end of the support arm 51. A hexagonal part of the nut bushing 57 is fitted in a C-groove 51*b* formed in the support arm 51. Thus, the nut bushing 57 is non-rotationally held at the lower end of the support arm 51.

The bolt 56 screwed into the nut bushing 57 is inserted into the fixing hole 51*a*. The cap 58 is fitted on the lower end of the support arm 51, thereby covering the bolt 56 and the nut bushing 57.

The adjuster knob 55 has a grip 55*a*, which is grasped when the adjuster knob 55 is operated, and a projecting part 55*b*, which contacts the lower hoop 5. The outer surface of the projecting part 55*b* has a generally hemispherical shape. The tom-tom supporting device 10 supports the lower hoop 5 with a distal end of the projecting part 55*b* held in contact with an outer peripheral surface of the lower hoop 5. In this state, the adjuster knob 55 is located between the second supporting portion 52 and the lower hoop 5. Therefore, the second supporting portion 52 elastically supports the lower hoop 5 by the distal end of the projecting part 55*b* and absorbs vibration transmitted from the batter head 2 to the lower hoop 5.

Figure 6A:
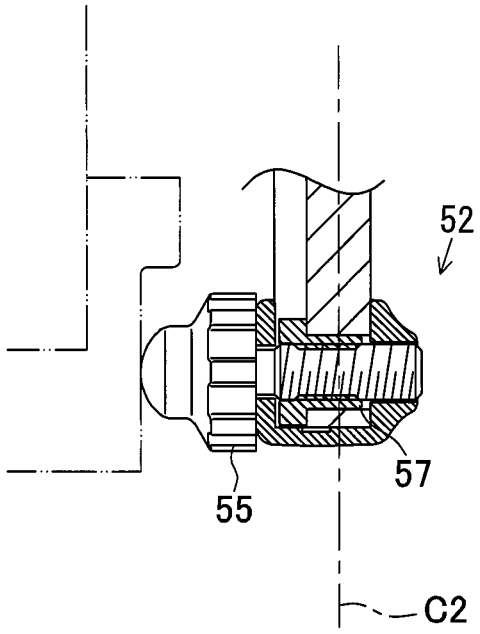
FIG. 6A is a partially cross-sectional view illustrating a state in which a projecting part is located near a lower end of a support arm.
Figure 6B:
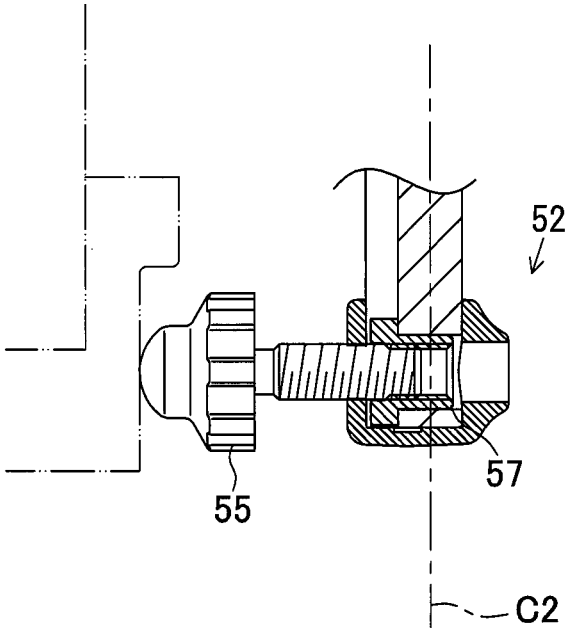
FIG. 6B is a partially cross-sectional view illustrating a state in which the projecting part juts out.

As illustrated in FIGS. 6A and 6B, the second supporting portion 52 can be moved back and forth in a front-rear direction perpendicular to the axis C2 of the second arm 50. Specifically, it is possible to move the projecting part 55*b* to jet out toward the axis C1 of the shell 1 and return the projecting part 55*b* back to a position close to the lower end of the support arm 51 by turning the adjuster knob 55 by hand so that the bolt 56 screwed into the nut bushing 57 moves back and forth.

Now, operation of the tom-tom supporting device 10 will be described with reference to FIGS. 1 and 4.

First, the tom-tom supporting device 10 is attached to the tom-tom TM. At this stage, the first arm 30 is mounted along an outer peripheral surface of the shell 1 with the pair of first supporting portions 40 fitted in the corresponding hoop attaching holes 4*b* formed in the upper hoop 4 and the restrictive mechanism 35 located near another hoop hole 4*a* formed in the upper hoop 4 as depicted in FIG. 1. Then, to engage the pair of first supporting portions 40 with the upper hoop 4, the nut 41 is fitted on the attaching screw 44 of each first supporting portion 40.

Next, the tom-tom supporting device 10 is attached to the tom-tom holder TH. At this stage, the distal end of the L-shaped rod LR is inserted into the through hole 26*a* formed in the bracket 20 as depicted in FIGS. 1 and 4, and the bracket 20 is secured to the distal end of the L-shaped rod LR by turning a wing bolt 13 by hand.

Subsequently, the bolt 25 is loosened so that the support arm 51 can be moved up and down in the bracket 20, whereby the height of the second supporting portion 52 is adjusted such that the height of the second supporting portion 52 matches that of the lower hoop 5 in accordance with the depth (height) of the shell 1.

Finally, the adjuster knob 55 is turned by hand to move the bolt 56 fitted in the nut bushing 57 back or forth, whereby the amount of projection of the projecting part 55*b* is adjusted so that the first arm 30 becomes parallel to the upper hoop 4. Accordingly, the tom-tom TM is mounted above the bass drum by fixing the tom-tom supporting device 10 to the tom-tom holder TH as described above.

In this state, the first supporting portions 40 are located near the two intersections P, Q, where the diameter DM of the batter head 2 intersects the upper hoop 4 as depicted in FIG. 1. In this case, the first supporting portions 40 provided at ends of the first arm 30 are located apart from each other, so that the weight of the tom-tom TM is not concentrated at one location of the upper hoop 4. Also, since a plurality of first supporting portions 40 supports the upper hoop 4 and the second supporting portion 52 supports the lower hoop 5, vibration of the shell 1 is not impeded by the first and second supporting portions 40, 52, or the like.

It is therefore possible to obtain the below-described advantages according to the present embodiment.

(1) The tom-tom supporting device 10 is configured to support a drum at two locations of the upper hoop 4 and one location of the lower hoop 5. For this reason, the vibration of the shell 1 is not impeded by the first and second supporting portions 40, 52, or the like. It is therefore possible to draw out the maximum potential of the vibration of the shell 1 and sufficiently obtain sustain and sound volume of the tom-tom TM. Also, the first supporting portions 40 are located near the two intersections P, Q, where the diameter DM of the batter head 2 intersects the upper hoop 4. That is, the first supporting portions 40 provided at the ends of the first arm 30 are located apart from each other, so that the weight of the tom-tom TM is not concentrated at one location of the upper hoop 4. Thus, it is possible to minimize deformation of the upper hoop 4 potentially caused by an impact produced when the tom-tom TM is struck and reduce the influence of such deformation of the upper hoop 4 on the sound volume or sound quality of the tom-tom TM as much as possible. This improves the sound volume and sound quality of the tom-tom TM.

(2) The pair of first supporting portions 40 is located at the generally symmetrical positions with respect to the axis C1 of the shell 1. In this case, it is possible to locate the first supporting portions 40 provided at the ends of the first arm 30 at locations most separated from each other. This arrangement makes it possible to efficiently distribute the weight of the tom-tom TM, which acts on the upper hoop 4. Accordingly, deformation of the upper hoop 4 caused by an impact produced when the tom-tom TM is struck, for example, is further suppressed and, thus, the influence of such deformation of the upper hoop 4 on the sound volume or sound quality of the tom-tom TM can be further reduced.

(3) The tom-tom supporting device 10 supports the upper hoop 4 with the rubber vibration insulator 43 placed between each first supporting portion 40 and the upper hoop 4. Also, the tom-tom supporting device 10 supports the lower hoop 5 with the adjuster knob 55 placed between the second supporting portion 52 and the lower hoop 5. In this case, it is possible to absorb vibration caused by an impact produced when the tom-tom TM is struck by means of the rubber vibration insulators 43 and the adjuster knob 55 made of vibration insulator material. For this reason, it is possible to prevent vibration of the tom-tom TM from being transmitted to the tom-tom holder TH through the upper and lower hoops 4, 5 and the bracket 20.

(4) The tom-tom supporting device 10 supports the upper hoop 4 with distal ends of the first supporting portions 40 engaged with the upper hoop 4. The tom-tom supporting device 10 also supports the lower hoop 5 with a distal end of the projecting part 55*b* held in contact with an outer peripheral surface of the lower hoop 5. The tom-tom TM is connected to the tom-tom holder TH via the bracket 20 on one side of the shell 1 as depicted in FIG. 4. In this case, the tom-tom TM receives forces that turn the tom-tom TM in such a direction that the upper open end of the shell 1 moves apart from the bracket 20 and the lower open end of the shell 1 moves closer to the bracket 20. The above-described structure of the embodiment utilizes this relationship between the forces applied to the tom-tom TM, wherein the first supporting portions 40 are secured to the upper hoop 4, which is attached to the upper open end of the shell 1, while the second supporting portion 52 is simply held in contact with the lower hoop 5, which is attached to the lower open end of the shell 1. This makes it possible to simplify the structure of the tom-tom supporting device 10.

(5) The height of the second supporting portion 52 can be adjusted by turning the bolt 25. Specifically, the height of the second supporting portion 52 can be adjusted by sliding the support arm 51 along the axis C1 of the shell 1 in accordance with the depth of the shell 1. This enables the tom-tom supporting device 10 to be adapted to various tom-toms TM having different sizes.

(6) The second supporting portion 52 can be moved back and forth along a front-rear direction perpendicular to the axis C2 of the second arm 50. Therefore, the amount of projection of the second supporting portion 52 projecting toward the axis C1 of the shell 1 can be adjusted. This arrangement serves to lessen compression of the rubber vibration insulator 43, which is placed between the upper hoop 4 and the first arm 30 and, thus, the influence of the compression of the rubber vibration insulator 43 on the sound volume or sound quality of the tom-tom TM can be reduced. Also, since the compression of the rubber vibration insulator 43 is lessened, it is possible to use a material having a low hardness for the rubber vibration insulator 43. This serves to improve a vibration isolating function of the rubber vibration insulator 43.

(7) There is a risk that the first arm 30 contacts the upper hoop 4 when the tom-tom TM swings during performance or when the tom-tom TM is removed from the tom-tom holder TH. According to present invention, there is provided the restrictive mechanism 35 in the middle portion 31 of the first arm 30 for restricting contact between the upper hoop 4 and the first arm 30. The restrictive mechanism 35 serves to prevent generation of a sound due to a contact between the upper hoop 4 and the first arm 30 as well as damage thereto. The restrictive mechanism 35 allows use of a low-hardness material for the rubber vibration insulator 43. It is therefore possible to further improve the vibration isolating function of the rubber vibration insulator 43.

Meanwhile, the foregoing embodiment may be modified in the below-described fashion.

Figure 7A:
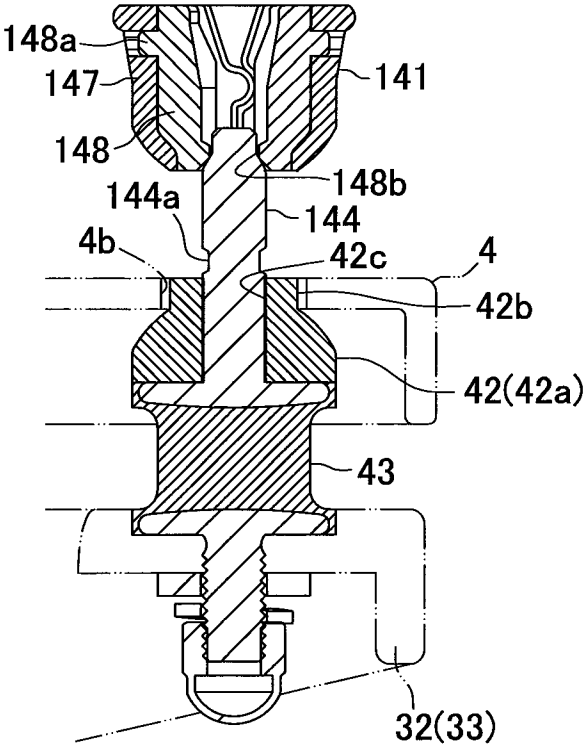
FIG. 7A is a partially cross-sectional view illustrating a state immediately before a nut is fitted on an attaching part in a modification of the invention.
Figure 7B:
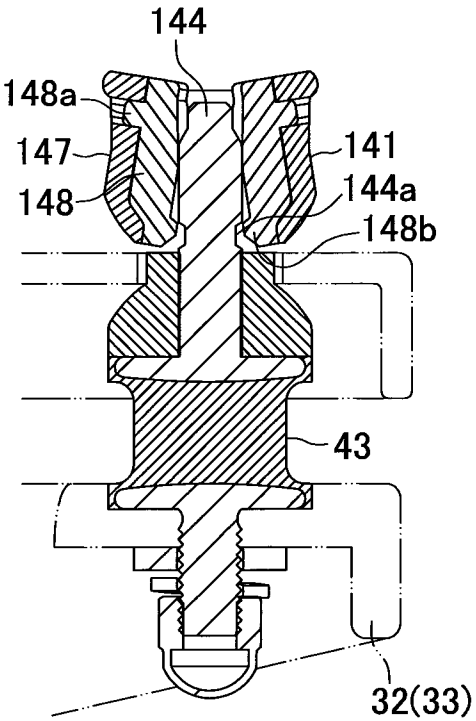
FIG. 7B is a partially cross-sectional view illustrating a state in which the nut is being fitted on the attaching part according to the modification.
Figure 7C:
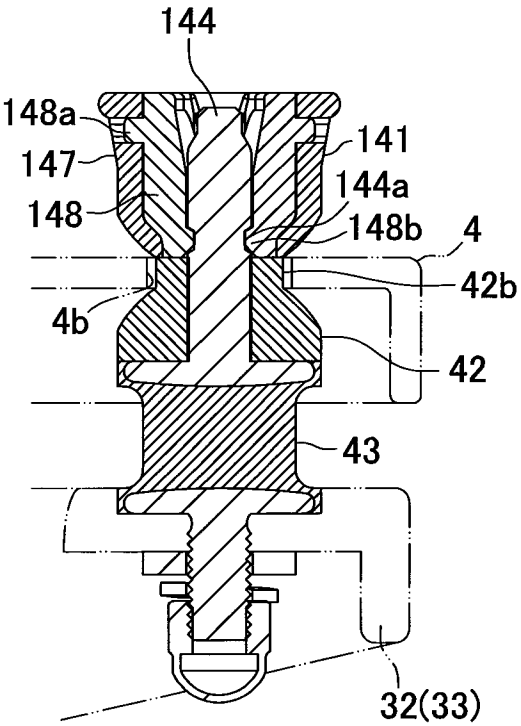
FIG. 7C is a partially cross-sectional view illustrating a state in which the nut has been fitted on the attaching part according to the modification.

The foregoing embodiment may be modified such that each of the nuts 41 is structured as described below. For example, each nut 141 may be configured to include a nut element 147 made of rubber and a clip 148 insert-molded in the nut element 147 as illustrated in FIGS. 7A to 7C. In this case, the clip 148 has a ridge 148*a* formed on an outer side surface thereof that is fitted inside the nut element 147. Also, a claw portion 148*b* is formed at one end of the clip 148 for gripping an upper attaching part 144. A groove 144*a* is formed in an outer peripheral surface of the attaching part 144, so that the claw portion 148*b* can fit in the groove 144*a*. Unlike the structure of the foregoing embodiment, the outer peripheral surface of the attaching part 144 is not externally threaded.

Described next is how the nut 141 is fitted on the attaching part 144.

First, the attaching part 144 is positioned such that a distal end thereof is located near an open end of the nut 141 as depicted in FIG. 7A. Next, the one end of the clip 148 is opened as depicted in FIG. 7B by gripping a basal end of the clip 148 from outside the nut 141. Subsequently, the attaching part 144 is inserted into the nut 141 from the end of the clip 148. After the attaching part 144 has been inserted into the nut 141, the end of the clip 148 is gripped inward so that the claw portion 148*b* fits in the groove 144*a* of the attaching part 144 as depicted in FIG. 7C. Incidentally, the aforementioned sequence of operations should be executed in a reverse order when removing the nut 141 from the attaching part 144.

While the right arm portion 30R and the left arm portion 30L, which constitute the first arm 30, are shaped to form a left-right symmetric structure extending on both sides of the middle portion 31 and have the same length in the aforementioned embodiment, the embodiment may be modified such that the right arm portion 30R and the left arm portion 30L are shaped asymmetrically about the middle portion 31 and thus have different lengths, depending on the number of tension bolt of the tom-tom TM. In this case, the right arm portion 30R and the left arm portion 30L extend up to points close to two intersections P and Q, where the diameter DM of the batter head 2 perpendicular to the vertical plane HS containing the axis C1 of the shell 1 and a midpoint of the first arm 30 in the lengthwise direction thereof intersects the upper hoop 4, respectively. Therefore, it is possible to locate the pair of first supporting portions 40 provided at the ends of the first arm 30 close to the two intersections P and Q, where the diameter DM of the batter head 2 perpendicular to the vertical plane HS containing the axis C1 of the shell 1 and the midpoint of the first arm 30 in the lengthwise direction thereof intersects the upper hoop 4. According to this structure, it is possible to locate the pair of first supporting portions 40 provided at the ends of the first arm 30 at locations most separated from each other, making it possible to efficiently distribute the weight of the tom-tom TM, which acts on the upper hoop 4, as in the foregoing embodiment.

The tom-tom supporting device 10 of the foregoing embodiment may be restructured such that the first supporting portions 40 support the lower hoop 5 and the second supporting portion 52 supports the upper hoop 4. In this case, the bottom head serves as the first drum head and the batter head serves as the second drum head.

The foregoing embodiment may be modified to include three or more first supporting portions 40. In this case, the first supporting portions 40 are provided at the ends of the first arm 30 and at a point between one or both ends of the first arm 30 and the middle portion 31 thereof.

In the foregoing embodiment, the nut 41 of each first supporting portion 40 may be omitted. In this case, the tom-tom TM can be attached to the tom-tom supporting device 10 by simply fitting the first supporting portions 40 in the corresponding hoop attaching holes 4*b* of the upper hoop 4.

According to the foregoing embodiment, the mount object, on which the tom-tom TM is mounted, need not necessarily be the bass drum but may be a cymbal stand or a dedicated tom-tom stand.

In the foregoing embodiment, the pair of first supporting portions 40 provided at the ends of the first arm 30 need not necessarily be located at symmetrical positions if the first supporting portions 40 are located near the two intersections P and Q, where the diameter DM of the batter head 2 intersects the upper hoop 4.

In the foregoing embodiment, the vibration insulator materials of the rubber vibration insulators 43 and the adjuster knob 55 need not necessarily be rubber but may be urethane, sponge, or the like, for example. It is also possible to omit the rubber vibration insulators 43 or to form the adjuster knob 55 by a material other than the vibration insulator material.

The foregoing embodiment may be modified such that the second supporting portion 52 also supports the lower hoop 5 with a distal end of the second supporting portion 52 engaged with the lower hoop 5 like the first supporting portions 40.

The above-described structure of the foregoing embodiment for adjusting the height of the second supporting portion 52 may be modified as follows. For example, a plurality of attaching holes may be formed in the support arm 51 along an axis thereof so that a position where the support arm 51 is attached to the bracket 20 can be varied stepwise to thereby adjust the height of the second supporting portion 52.

The above-described structure of the foregoing embodiment for adjusting the height of the second supporting portion 52 may be omitted from the tom-tom supporting device 10.

The foregoing embodiment may be modified to include two or more restrictive mechanisms 35. Also, the restrictive mechanism 35 may be omitted from the tom-tom supporting device 10. Further, instead of eliminating the restrictive mechanism 35 from the tom-tom supporting device 10, the upper hoop 4 or the lower hoop 5 may be provided with a restrictive mechanism 35 at an appropriate position in accordance with the location of the first arm 30.

In the foregoing embodiment, the restrictive mechanism 35 may be set at a position other than a middle position of the first arm 30 or at any arbitrary position of the first arm 30 in a circumferential direction thereof except for the ends.

The tom-tom supporting device of the foregoing embodiment may be modified to function as a supporting device for supporting a drum other than the tom-tom, such as a snare drum.

The invention claimed is:

1. A drum supporting device for supporting a drum on a mount object on which the drum is mounted, the drum including:

a shell;

first and second drum heads covering first and second open ends of the shell, respectively;

a first hoop attached to the first open end of the shell together with the first drum head; and a second hoop attached to the second open end of the shell together with the second drum head, the drum supporting device comprising:

a bracket joined to the mount object;

a first arm having at least two first supporting portions for supporting the first hoop, the first arm being provided at a first end of the bracket and extending in a circumferential direction of the shell; and a second arm having a second supporting portion for supporting the second hoop, the second arm being provided at a second end of the bracket and extending in the direction of an axis of the shell, wherein the two first supporting portions are respectively provided at opposite ends of the first arm and are each located near one of two locations at which a diameter of the first drum head intersects the first hoop, and wherein the diameter is perpendicular to a plane that contains the axis of the shell and a midpoint of the first arm in a longitudinal direction of the first arm, and wherein the second supporting portion projects toward the axis of the shell and is configured to adjust the position of the second supporting portion in a front-rear direction perpendicular to the axis of the second arm.

2. The drum supporting device according to claim 1, wherein the first supporting portions provided at the ends of the first arm are each located near one of two intersections where the diameter of the first drum head perpendicular to a plane containing the axis of the shell and an axis of the second arm intersects the first hoop.

3. The drum supporting device according to claim 1, wherein the two first supporting portions are located at symmetrical positions with respect to the axis of the shell.

4. The drum supporting device according to claim 1, wherein the first supporting portions support the first hoop with a first vibration insulator material placed between the first supporting portions and the first hoop, and the second supporting portion supports the second hoop with a second vibration insulator material placed between the second supporting portion and the second hoop.

5. The drum supporting device according to claim 1, wherein the first drum head is a batter head struck by a performer, and the first hoop is an upper hoop, which is attached to an upper open end of the shell together with the batter head.

6. The drum supporting device according to claim 5, wherein the first supporting portions support the first hoop with distal ends of the first supporting portions engaged with the first hoop, and the second supporting portion supports the second hoop with a distal end of the second supporting portion held in contact with the second hoop.

7. The drum supporting device according to claim 5, wherein the second arm is configured to adjust the height of the second supporting portion in the direction of the axis of the shell.

8. The drum supporting device according to claim 5, wherein the first arm is provided with a restrictive mechanism for restricting contact between the first hoop and the first arm.

9. The drum supporting device according to claim 1, wherein the second arm supports the second hoop at a single location of the second hoop.

10. The drum supporting device according to claim 1, wherein the second supporting portion includes a nut provided on the second arm and an adjuster knob having a bolt screwed into the nut, the second supporting portion is configured to be movable in the front-rear direction by turning the adjuster knob so that the bolt screwed into the nut moves back and forth.

11. A drum comprising:

a shell;

first and second drum heads covering first and second open ends of the shell, respectively;

a first hoop attached to the first open end of the shell together with the first drum head;

a second hoop attached to the second open end of the shell together with the second drum head;

a bracket joined to a mount object on which the drum is mounted;

a first arm having at least two first supporting portions for supporting the first hoop, the first arm being provided at a first end of the bracket and extending in a circumferential direction of the shell; and a second arm having a second supporting portion for supporting the second hoop, the second arm being provided at a second end of the bracket and extending in the direction of an axis of the shell;

wherein the two first supporting portions are respectively provided at opposite ends of the first arm and are each located near one of two locations at which a diameter of the first drum head intersects the first hoop, and wherein the diameter is perpendicular to a plane that contains the axis of the shell and a midpoint of the first arm in a longitudinal direction of the first arm, and wherein the second supporting portion projects toward the axis of the shell and is configured to adjust the position of the second supporting portion in a front-rear direction perpendicular to the axis of the second arm.

12. The drum supporting device according to claim 11, wherein the second arm supports the second hoop at a single location of the second hoop.

13. The drum supporting device according to claim 11, wherein the second supporting portion includes a nut provided on the second arm and an adjuster knob having a bolt screwed into the nut, the second supporting portion is configured to be movable in the front-rear direction by turning the adjuster knob so that the bolt screwed into the nut moves back and forth.

* * * * *